US006467574B2

(12) United States Patent
Lara

(10) Patent No.: US 6,467,574 B2
(45) Date of Patent: Oct. 22, 2002

(54) SLIDING MEMBER FOR USE WITH A LIFE-LINE

(75) Inventor: Pascal Lara, Vierzon (FR)

(73) Assignee: Dalloz Fall Protection, Vierzon (FR)

( * ) Notice: Subject to any disclaimer, the term of this patent is extended or adjusted under 35 U.S.C. 154(b) by 0 days.

(21) Appl. No.: 09/938,651

(22) Filed: Aug. 27, 2001

(65) Prior Publication Data

US 2002/0050421 A1 May 2, 2002

(30) Foreign Application Priority Data

Sep. 13, 2000 (FR) ..... 00 11647

(51) Int. Cl.[7] ..... E04G 3/14
(52) U.S. Cl. ..... 182/36; 182/3; 182/5
(58) Field of Search ..... 182/3, 5, 9, 11, 182/36, 235; 248/237; 104/115

(56) References Cited

U.S. PATENT DOCUMENTS 4,721,182 A 1/1988 Brinkmann et al.
4,790,410 A * 12/1988 Sharp et al. ..... 182/36
5,279,385 A 1/1994 Riches et al.
5,343,975 A * 9/1994 Riches et al. ..... 182/3 X
6,059,072 A * 5/2000 Cho ..... 182/5 X
6,073,724 A * 6/2000 Wolner et al. ..... 182/3
6,206,137 B1 * 3/2001 Wolner et al. ..... 182/3
6,263,999 B1 * 7/2001 Atkinson et al. ..... 182/5
6,330,861 B1 * 12/2001 Flux ..... 182/3 X

FOREIGN PATENT DOCUMENTS

| | | |
|---|---|---|
| EP | 0608164 | 7/1994 |
| FR | 2431299 | 2/1980 |
| GB | 2338506 | 12/1999 |
| WO | 92/20407 | 11/1992 |

* cited by examiner

*Primary Examiner*—Bruce A. Lev
(74) *Attorney, Agent, or Firm*—Greenblum & Bernstein, P.L.C.

(57) ABSTRACT

A sliding member for use with a life-line comprises a mobile jaw delimiting with a fixed jaw a channel for guiding it on a cable. The jaw is held partly open in an intermediate configuration, opened to mount the sliding member on the cable, and closed completely if traction is exerted on a handle connected by a line to a harness.

9 Claims, 7 Drawing Sheets

SLIDING MEMBER FOR USE WITH A LIFE-LINE

CROSS-REFERENCE TO RELATED APPLICATIONS

This application is based on French Patent Application No. 00 11 647 filed Sep. 13, 2000, the disclosure of which is hereby incorporated by reference thereto in its entirety, and the priority of which is hereby claimed under 35 U.S.C. §119.

BACKGROUND OF THE INVENTION

Field of the Invention

The invention is more particularly directed to a sliding member adapted to be mounted on a life-line fixed horizontally along a wall, the sliding member being intended to be connected by a cable to a harness or to a belt worn by a worker working along the wall in order to protect the worker in the event of an accidental fall.

The present invention therefore provides a sliding member that can easily be mounted on the life-line, that can slide easily thereon, and that offers a high level of safety.

SUMMARY OF THE INVENTION

The sliding member in accordance with the invention is for use with a horizontal life-line comprising a cable extending along a wall and connected thereto by supports, the sliding member comprising a body having a channel in which the cable slides, a handle intended to receive one end of a lanyard whose other end is connected to a safety harness, a mobile jaw adapted to form a slot in the channel to enable the sliding member to be mounted on the cable, a mechanism for holding the jaw slightly open in an intermediate first configuration to form a slot corresponding to the thickness of the supports for the cable, a device for commanding opening of the jaw to increase the size of the slot in an open second configuration, in order to be able to mount the sliding member on the cable, and an element for automatically placing the sliding member in a safety configuration if traction is applied to the handle in which the mobile jaw is pivoted so that the slot is completely blocked.

The sliding member can therefore be mounted on the cable very easily and can slide easily along the cable, even at the location of its supports, and the slot is closed if the user should fall.

In accordance with one constructional feature, the mobile jaw is articulated on a shaft and includes a heel mobile inside the body against the action of a spring mechanism biasing the mobile jaw toward a configuration closing the slot, the handle is supported by a shaft mobile in a passage of the heel, the body includes a cam with which the shaft of the handle cooperates, the cam and the passage are inclined in opposite directions to the vertical so that, if the shaft of the handle is moved down, the jaw tends to pivot toward the safety configuration, whereas if the shaft of the handle is moved up, the jaw tends to pivot toward the open configuration.

In accordance with another feature, the heel includes a transverse opening in which a plunger slides against the action of a spring mechanism, the plunger including a notch adapted to be moved so that it is opposite the shaft of the handle so that the shaft can be moved upward so that the jaw can pivot toward the open configuration.

In accordance with another constructional feature, the shaft of the handle is pushed up by a spring mechanism to bear against the plunger, in which position it holds the jaw in the intermediate configuration.

The spring mechanism for biasing the mobile jaw toward the position in which it closes the slot preferably consist of a layer of a resilient cellular plastics material.

Finally, the spring mechanism for biasing the shaft of the handle upward in the passage consist of a layer of a resilient cellular plastics material between the bottom of the passage and the shaft.

According to an aspect of the invention, a sliding member is provided for use with a horizontal life-line including a cable extending along a wall and connected thereto by supports, the sliding member comprising a body having a channel in which the cable slides and a handle for receiving one end of a lanyard whose other end is connected to a safety harness. A movable jaw is adapted to form a slot in the channel to enable the sliding member to be mounted on the cable. A mechanism is provided for holding the movable jaw slightly open in an intermediate first configuration to form a slot corresponding to a thickness of the supports for the cable. A device is provided for opening the movable jaw to increase the size of the slot in an open second configuration, in order to mount the sliding member on the cable. An element is provided for automatically placing the sliding member in a safety configuration if traction is applied to the handle, wherein the movable jaw is pivoted so that the slot is completely blocked.

According to another aspect of the invention, the movable jaw is articulated on a shaft and includes a heel movable inside the body against the action of a spring mechanism biasing the movable jaw toward a configuration closing the slot, the handle being supported by a shaft movable in a passage of the heel, the body including a cam with which the shaft of the handle cooperates, the cam and the passage being inclined in opposite directions to the vertical so that, if the shaft of the handle is moved downwardly, the movable jaw tends to pivot toward the safety configuration, whereas if the shaft of the handle is moved upwardly, the jaw tends to pivot toward the open configuration.

According to yet another aspect of the invention, the heel includes a transverse opening in which a plunger slides against the action of a spring mechanism, the plunger including a notch adapted to be moved so that it is opposite the shaft of the handle to enable the shaft to move upwardly so that the movable jaw is able to pivot toward the open configuration.

Moreover, according to the invention, the shaft of the handle may be pushed upwardly by a spring mechanism to bear against the plunger, in which position it holds the movable jaw in the intermediate configuration. Additionally, the spring mechanism for biasing the movable jaw toward the position in which it closes the slot may comprise a layer of a resilient cellular plastic material. Furthermore, the spring mechanism for biasing the shaft of the handle upwardly in the passage may comprise a layer of a resilient cellular plastic material between the bottom of the passage and the shaft.

According to the invention, the movable jaw may include a heel, the heel including a transverse opening in which a plunger slides against the action of a spring mechanism, the plunger including a notch adapted to be moved so that it is opposite the shaft of the handle to enable the shaft to move upwardly so that the movable jaw is able to pivot toward the open configuration. Furthermore, the movable jaw may be articulated on a shaft, the shaft being pushed upwardly by a spring mechanism to bear against the plunger, in which position it holds the movable jaw in the intermediate configuration. Moreover, the movable jaw may be articulated on a shaft and be movable against the action of a spring mechanism biasing the movable jaw toward a configuration closing the slot, the spring mechanism comprising a layer of a resilient cellular plastic material.

The invention will now be described in more detail with reference to one particular embodiment given by way of example only and shown in the appended drawings.

DETAILED DESCRIPTION OF THE DRAWINGS

Figure 1:
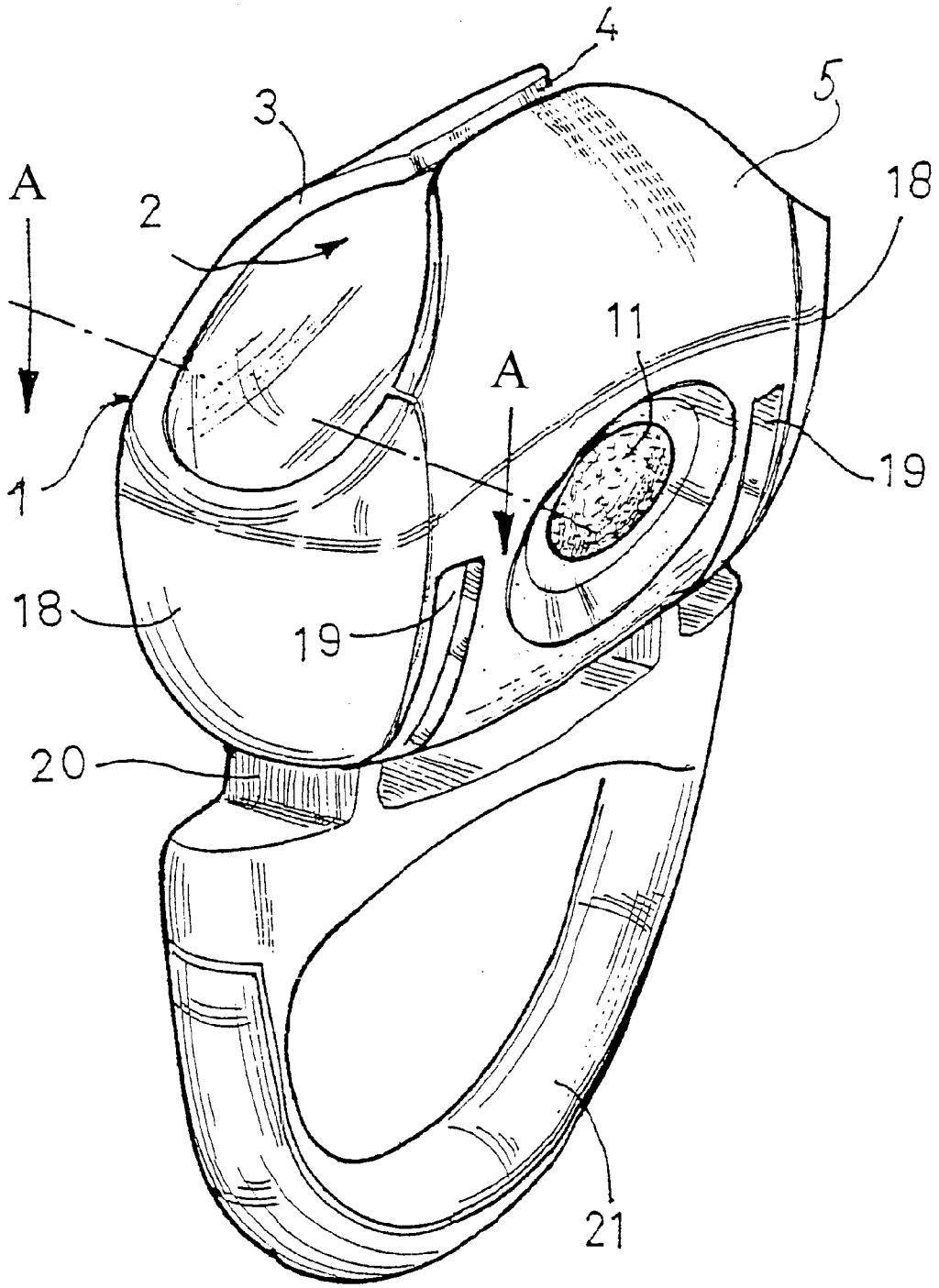
FIG. 1 is a perspective view of a sliding member in accordance with the invention in an intermediate configuration.

The sliding member shown in the figures comprises a body 1 having in its upper part a channel 2 with a slot 4 and delimited by a fixed jaw 3 and a mobile jaw 5, the latter being articulated on a shaft 6 and being extended by a heel 7 mobile inside the body 1 against the action of a spring mechanism comprising a layer 8 of resilient cellular plastics material.

An opening 10 delimited by guide surfaces 13 and 14 is formed in the heel 7 for a plunger 11 mounted in the opening 10 and able to slide against the action of the spring mechanism 8.

The plunger 11 is accessible from the outside via the opening 10 in the lower part of the jaw 5 and has a notch 12 on the face that faces downward and a rebate 16 on the opposite face.

The shaft 6 is supported by bearings 17 in flanges 18 of the body 1.

The body 1 has two slots 19 into which are inserted lugs 20 attached to a handle 21 intended to receive a carabiner fastened to one end of a lanyard whose other end is fixed to a safety harness worn by a user.

The lugs 20 are fastened to a shaft 25 that passes through a passage 26 in the heel 7 and whose ends are guided in cams 27 in the flanges 18, the bottom of the passage 26 being lined with a layer 28 of resilient plastics material to constitute a spring member biasing the shaft 25 into an intermediate configuration in which it abuts against the plunger 11.

The passage 26 is inclined to the vertical so that its bottom is closer to the spring mechanism 8 than its top.

Figure 8:
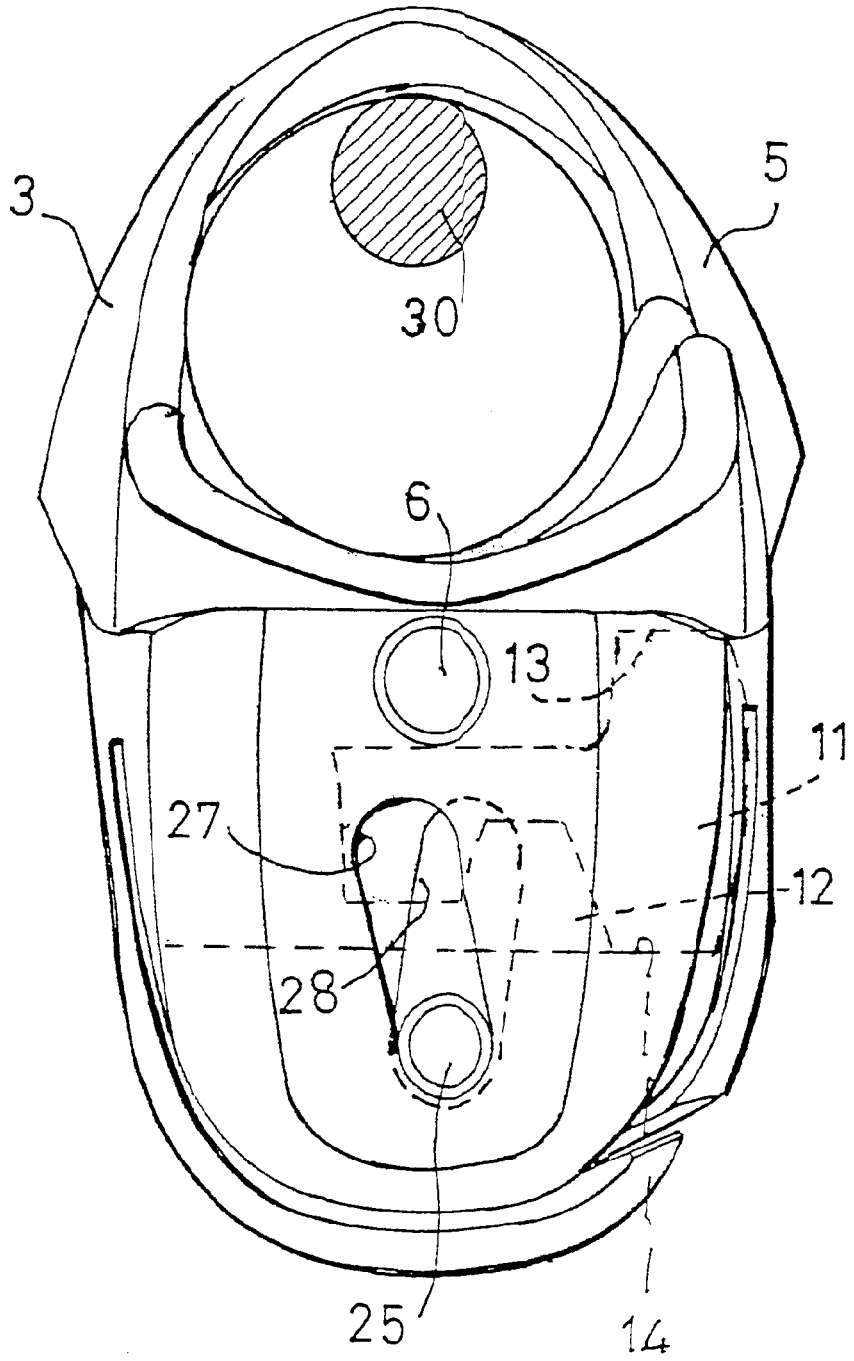
FIG. 8 is a view similar to FIGS. 6 and 7 except that the sliding member is in an active configuration because the user is sensed to have fallen.

The cams 27 are inclined in opposite directions relative to the passage 26 and the bottom of the passage 26 and the lower end of the cam 27 coincide in a configuration in which the jaw 5 abuts against the fixed jaw 3, with the slot 4 closed (see FIG. 8).

Figure 3:
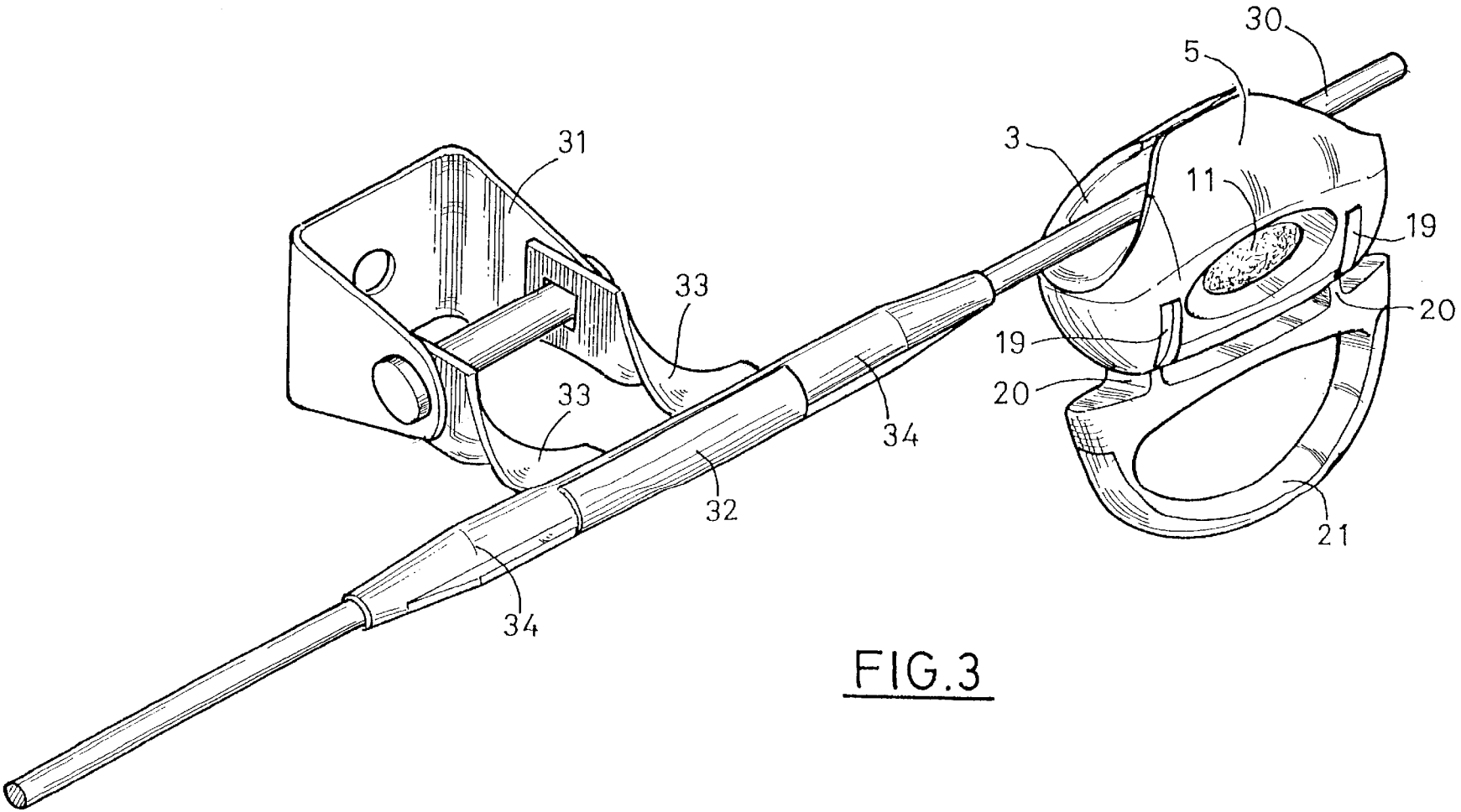
FIG. 3 is a perspective view of the sliding member in the intermediate configuration mounted on a life-line.

As shown in FIG. 3, the sliding member is 30 intended to be used on a life-line including a horizontal cable 30 extending along a wall and supported by a bracket 31 mounted on a wall and to which are fixed lugs 33 on a stirrup 32 through which the cable 30 passes and which are extended by frustoconical sleeves 34.

Figure 6:
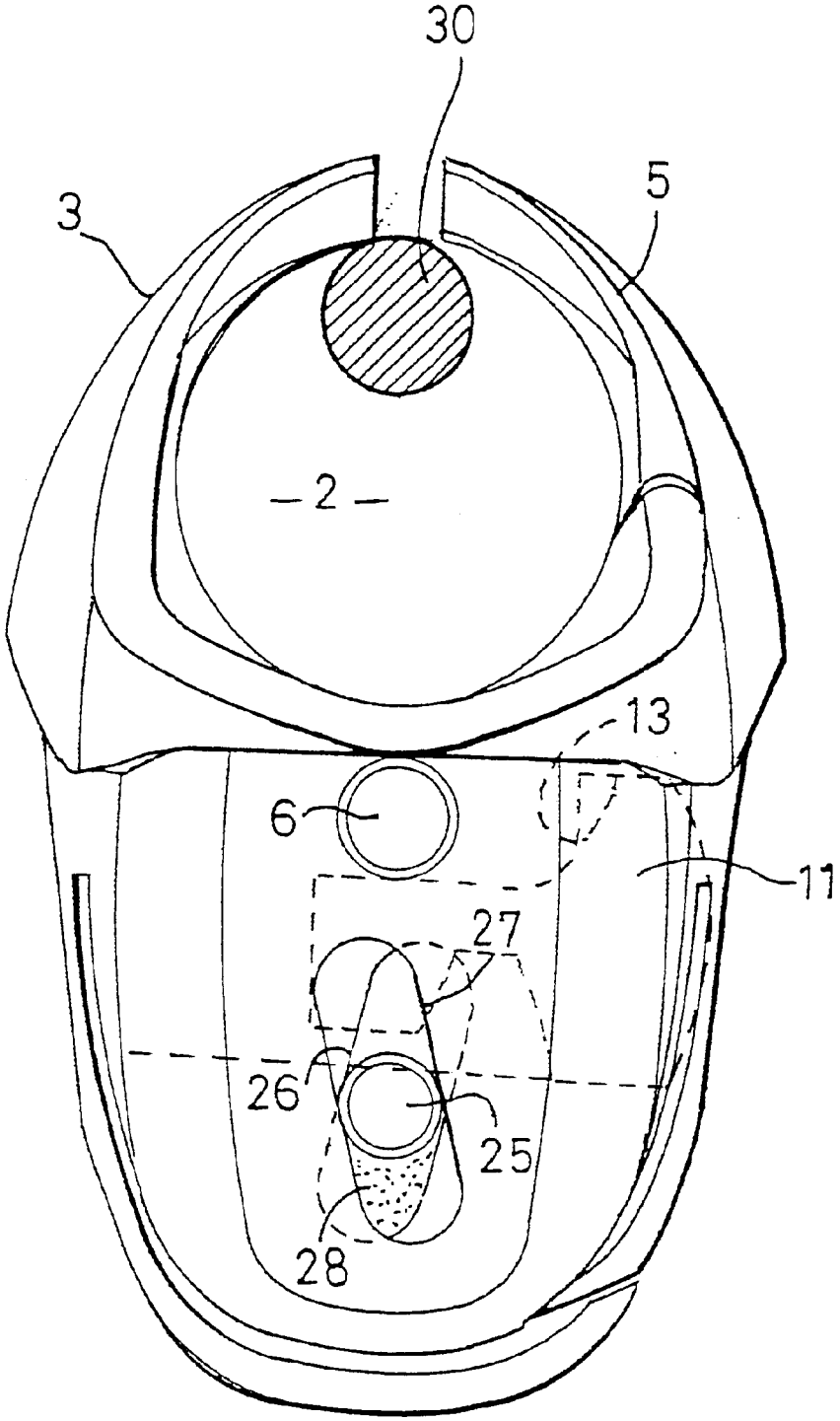
FIG. 6 is a view in section taken along the line A—A in FIG. 1.

The sliding member has three configurations; in an intermediate configuration (see FIGS. 1, 3 and 6) the jaw 5 is slightly spaced away from the jaw 3 to leave the slot 4 open, the width of the latter being less than the diameter of the cable 30 but slightly greater than the thickness of the lugs 33 so that the sliding member can pass freely over the stirrup 32 subject to pivoting on the sleeves 34. Note that the sliding member in accordance with the invention can therefore be used for movement in either direction because the body 1 can pivot freely either way on the lugs 20.

Figure 2:
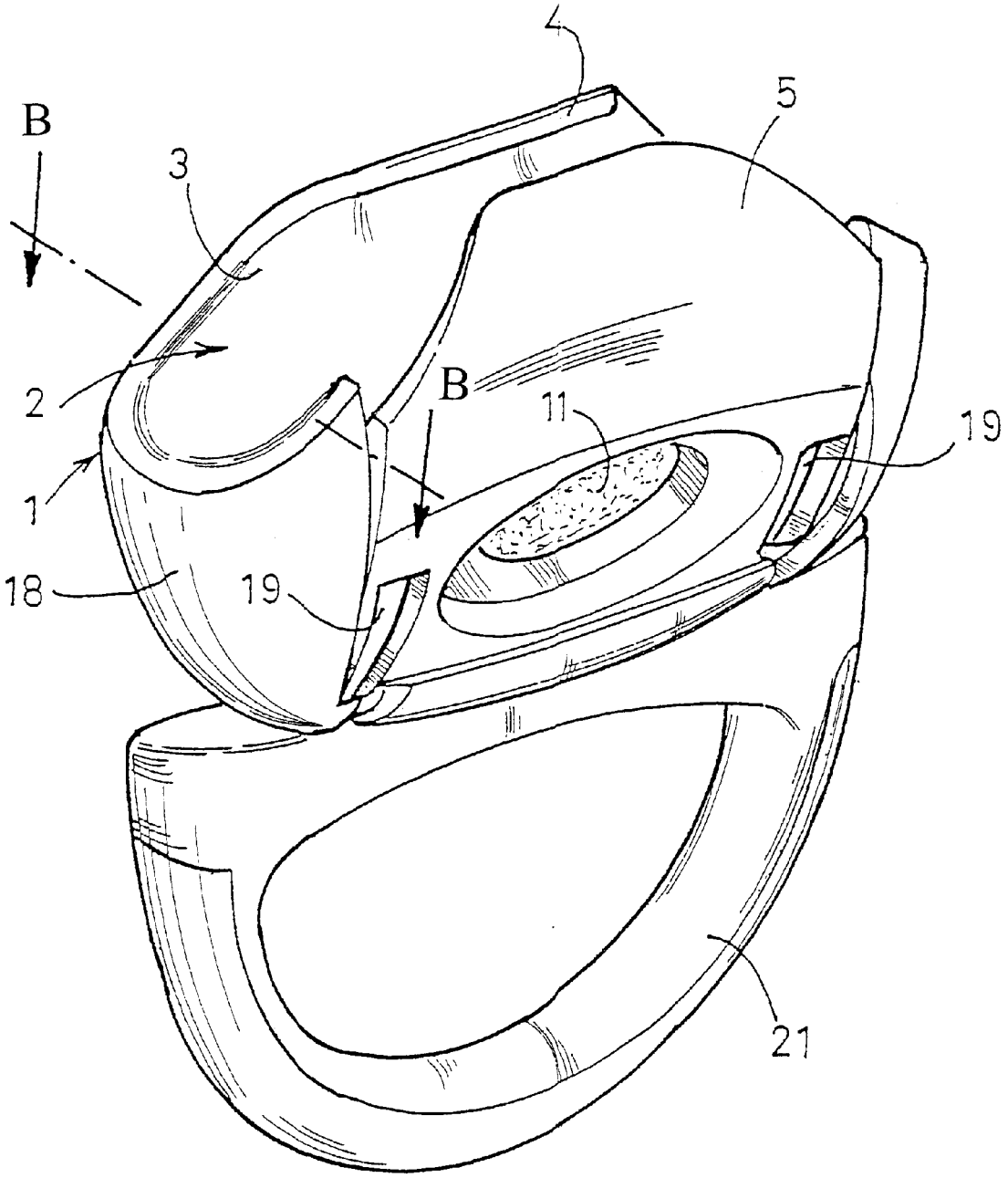
FIG. 2 is a perspective view of the sliding member in an open configuration.
Figure 5:
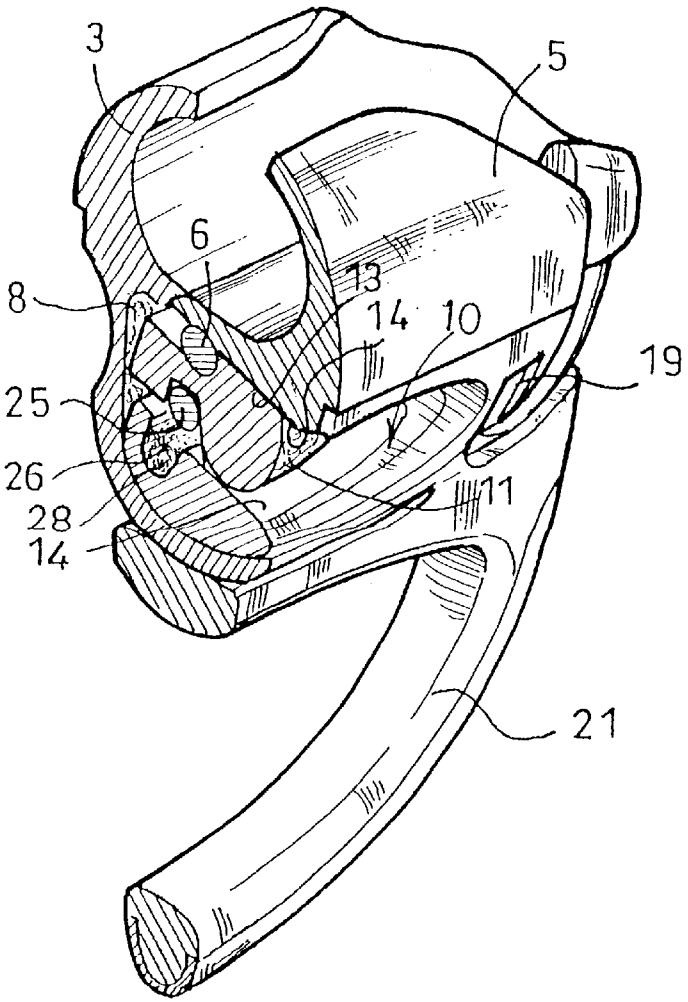
FIGS. 4 and 5 are partly cut away perspective views respectively showing the sliding member in the intermediate configuration and in the open configuration.
Figure 4:
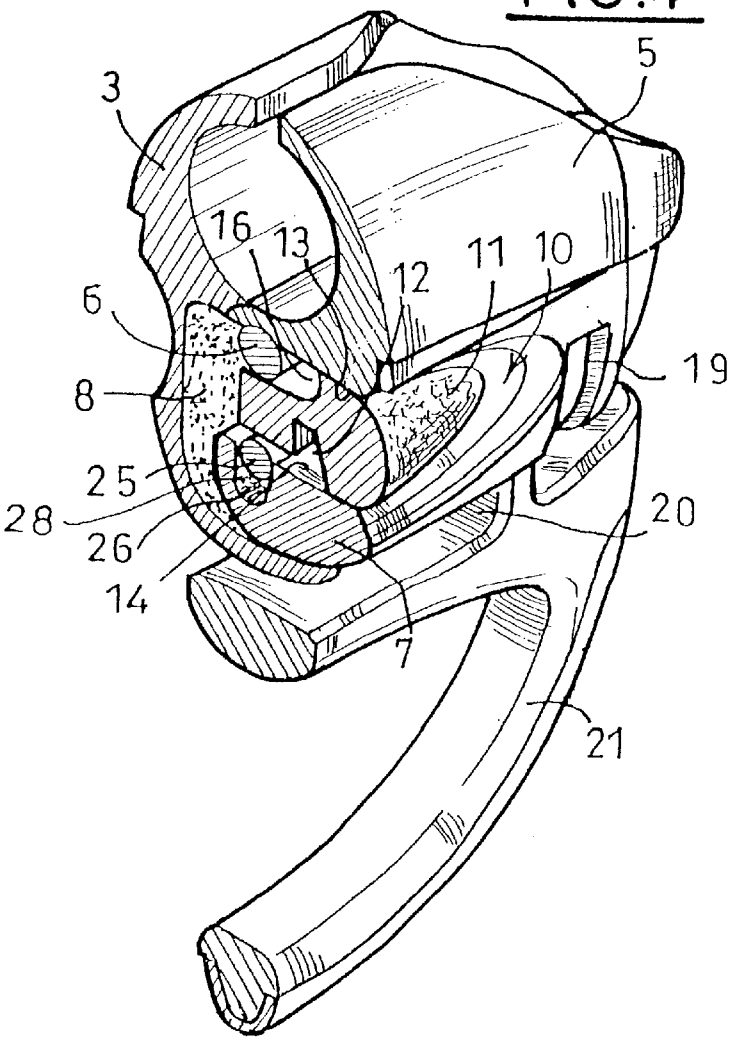
Figure 7:
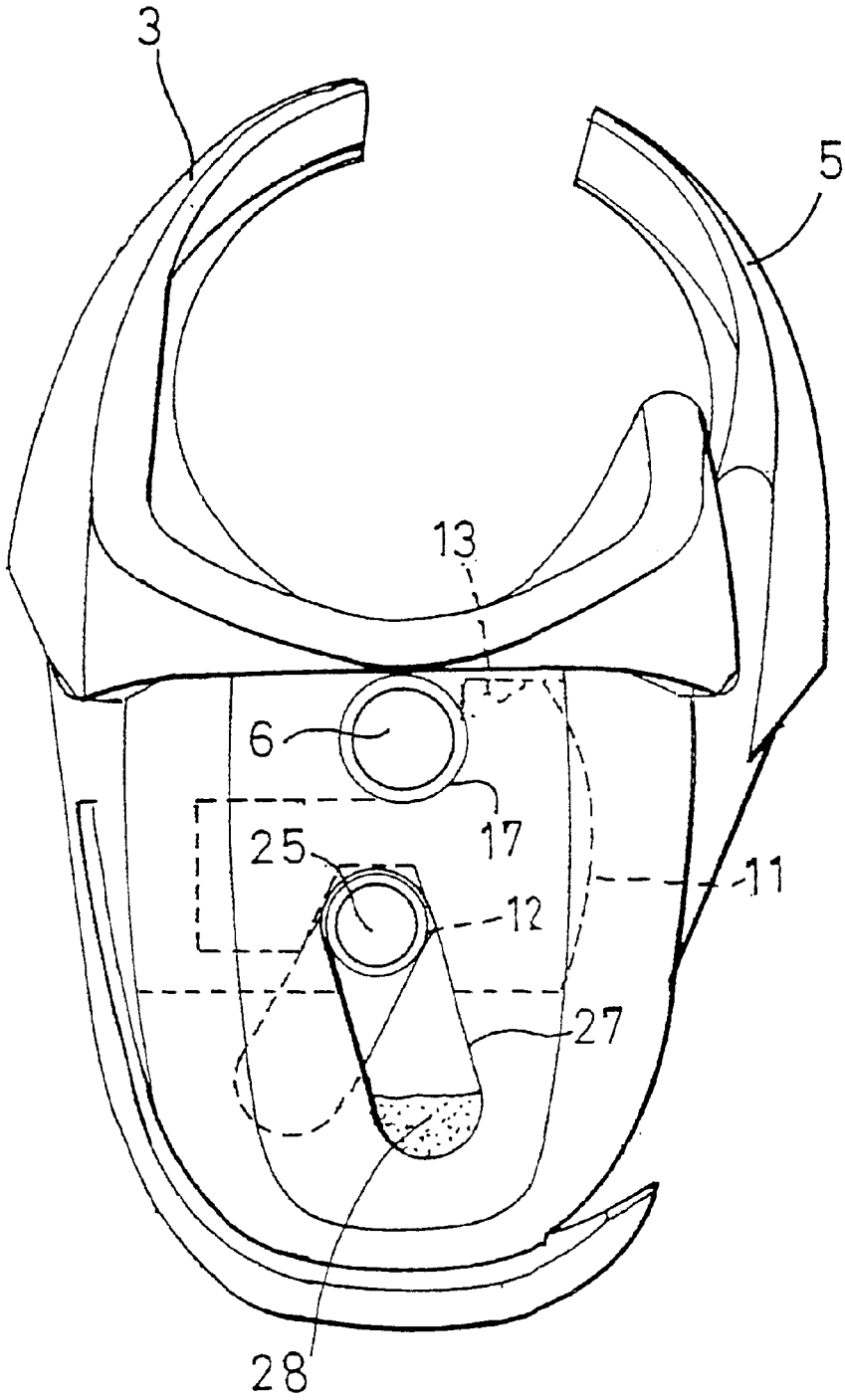
FIG. 7 is a view in section taken along the line B—B in FIG. 2.

The second configuration of the sliding member is an open configuration (see FIGS. 2, 5 and 7) allowing the sliding member to be mounted on the cable 30, the jaw 5 being pivoted so that the slot 4 is wide enough for the cable 30 to pass through it.

Finally, the third configuration is a safety configuration (see FIG. 8). This configuration is obtained automatically if the handle 21 is pulled, for example in the event of a fall, and in this case the jaw 5 is clamped against the fixed jaw 3, and the slot 4 is therefore closed.

The relaxed configuration of the sliding member is the first configuration; if the jaw 5 is to be moved to the second configuration, pressure is applied to the plunger 11 (see FIGS. 5 and 7) and the shaft 25 is pushed by the upward pivoting of the handle 21 into the notch 12, sliding in the passage 26. The sliding of the shaft 25 is guided by the cams 27, which are inclined and cause the jaw 5 to pivot on its shaft 6.

(To return the sliding member to the first configuration, it is sufficient to let go of the handle 21, whereupon the spring mechanism 8 cause the shaft 25 to escape from the notch 12 and the plunger 11 is returned to its initial configuration by the layer 8 of elastic material. Note that in this intermediate configuration the shaft 25 is slightly spaced away from the bottom of the passage 26 by the layer 28 (see FIG. 6). If traction is applied to the handle 21 (see FIG. 8), the shaft 25 is pulled down and compresses the layer 28 of flexible and resilient material; during this movement, the cam 27 obliges the heel 7 to pivot in the direction of closing the slot 4, corresponding to the safety configuration.

The sliding member returns automatically to its intermediate configuration when traction is removed from the handle 21.

Clearly a device of the above kind is very safe and is particularly simple to use, avoiding all risk of misoperation.

Of course, the invention is not limited to the embodiment shown and just described, to which many detailed modifications can be made without departing from the scope of the invention.

There is claimed:

1. A sliding member for use with a horizontal life-line including a cable extending along a wall and connected thereto by supports, said sliding member comprising:

a body having a channel whereby a cable is adapted to slide within the channel;

a handle adapted to receiving, one end of a lanyard whose other end is connected to a safety harness;

a movable jaw adapted to form a slot in said channel to enable said sliding member to be mounted on a cable;

a mechanism for holding said movable jaw slightly open in an intermediate first configuration to form the slot corresponding to a thickness whereby the thickness is adapted to be greater than a thickness of supports for a cable;

a device for opening said movable jaw to increase the size of said slot in an open second configuration, whereby in the open second configuration, the sliding member is adapted to be mounted on a cable; and an element for automatically placing said sliding member in a safety configuration if traction is applied to said handle, wherein said movable jaw is pivoted so that said slot is completely blocked.

2. The sliding member according to claim 1, wherein said movable jaw is articulated on a shaft and includes a heel movable inside said body against the action of a spring mechanism biasing said movable jaw toward a configuration closing said slot, said handle being supported by a shaft movable in a passage of said heel, said body includes a cam with which said shaft of said handle cooperates, said cam and said passage being inclined in opposite directions to the vertical so that, if said shaft of said handle is moved downwardly, said movable jaw tends to pivot toward said safety configuration, whereas if said shaft of said handle is moved upwardly, said jaw tends to pivot toward said open configuration.

3. The sliding member according to claim, 2, wherein said heel includes a transverse opening in which a plunger slides against the action of a spring mechanism, said plunger including a notch adapted to be moved so that it is opposite said shaft of said handle to enable said shaft to move upwardly so that said movable jaw is able to pivot toward said open configuration.

4. The sliding member according to claim 2, wherein said shaft of said handle is pushed upwardly by a spring mechanism to bear against said plunger, in which position it holds said movable jaw in said intermediate configuration.

5. The sliding member according to claim 4, wherein said spring mechanism for biasing said shaft of said handle upwardly in said passage comprises a layer of a resilient cellular plastic material between the bottom of said passage and said shaft.

6. The sliding member according to claim 2, wherein said spring mechanism for biasing said movable jaw toward the position in which it closes said slot comprises a layer of a resilient cellular plastic material.

7. The sliding member according to claim 1, wherein said movable jaw included a heel, said heel including a transverse opening in which a plunger slides against the action of a spring mechanism, said plunger including a notch adapted to be moved so that it is opposite said shaft of said handle to enable said shaft to move upwardly so that said movable jaw is able to pivot toward said open configuration.

8. The sliding member according to claim 7, herein said movable jaw is articulated on a shaft, said shaft being pushed upwardly by a spring mechanism to bear against said plunger, in which position it holds said movable jaw in said intermediate configurations.

9. The sliding member according to claim 1, wherein said movable jaw is articulated on a shaft and is movable against the action of a spring mechanism biasing said movable jaw toward a configuration closing said slot, said spring mechanism comprising a layer of a resilient cellular plastic material.

* * * * *